US007496206B2

(12) United States Patent
Husung

(10) Patent No.: US 7,496,206 B2
(45) Date of Patent: Feb. 24, 2009

(54) HEARING AID WITH A MAGNETIC FIELD-CONTROLLED SWITCH, AND OPERATING METHOD THEREFOR

(75) Inventor: Kunibert Husung, Erlangen (DE)

(73) Assignee: Siemens Audiologische Technik GmbH, Munich (DE)

( * ) Notice: Subject to any disclaimer, the term of this patent is extended or adjusted under 35 U.S.C. 154(b) by 649 days.

(21) Appl. No.: 10/949,893

(22) Filed: Sep. 24, 2004

(65) Prior Publication Data

US 2005/0105752 A1 May 19, 2005

(30) Foreign Application Priority Data

Sep. 24, 2003 (DE) ..... 103 44 367

(51) Int. Cl.
*H04R 25/00* (2006.01)

(52) U.S. Cl. ..... 381/312; 381/326; 381/329; 381/331

(58) Field of Classification Search ..... 381/312, 381/314, 323, 324, 327, 328, 331
See application file for complete search history.

(56) References Cited

U.S. PATENT DOCUMENTS

| | | | | |
|---|---|---|---|---|
| 4,467,145 | A | 8/1984 | Borstel | |
| 4,995,085 | A | 2/1991 | Kern et al. | |
| 2004/0052392 | A1 * | 3/2004 | Sacha et al. | 381/331 |

FOREIGN PATENT DOCUMENTS

| | | | |
|---|---|---|---|
| DE | 196 33 321 | | 11/1997 |
| DE | 299 23 019 | | 5/2000 |
| EP | 1 398 995 | | 9/2003 |
| JP | 07043442 | A * | 2/1995 |

* cited by examiner

*Primary Examiner*—Wayne Young
*Assistant Examiner*—Dionne H Pendleton
(74) *Attorney, Agent, or Firm*—Schiff Hardin LLP

(57) ABSTRACT

In a hearing aid with a magnetic field-controlled switch and a method for operating such a hearing aid, the magnetic field sensor for automatically switching the hearing aid is miniaturized and made more cost-effective by the use of a ferrite component as the magnetic field sensor. This component can be evaluated by a Wheatstone bridge circuit which is fed by an oscillator. In this context, a measuring amplifier with a threshold value detector supplies a corresponding switching signal for the hearing aid.

7 Claims, 2 Drawing Sheets

HEARING AID WITH A MAGNETIC FIELD-CONTROLLED SWITCH, AND OPERATING METHOD THEREFOR

BACKGROUND OF THE INVENTION

1. Field of the Invention

The present invention relates to a hearing aid of the type having a first hearing aid function, a second hearing aid function and a switching device for automatically switching the first hearing aid function into the second hearing aid function. Furthermore, the present invention relates to a method for operating such a hearing aid.

2. Description of the Prior Art

In order to improve the operability of a hearing aid it may be appropriate to control important operator control functions automatically. As a result, savings in terms of operator controls can be achieved and the hearing aid can be made more convenient.

Hearing aids of the above-general type are known, for example, from the company Hansaton. Such hearing aids have one or more reed contacts for carrying out the automatic switching between a number of functions of the hearing aid. As a result, it is possible to switch the hearing aid automatically from the microphone-operating mode to the telephone coil operating mode if a telephone receiver is held against the ear provided with the hearing aid, since the receiver is generally equipped with a permanent magnet. Similar hearing aids are also known from DE 31 09 049 C2, DE 299 23 019 U1, DE 196 33 321 A1 and DE 37 34 946 C2.

A further application for magnetic field-controlled automatic switching of a hearing aid is its automatic deactivation when the hearing aid is placed in its storage box or charge station. For this purpose there is a small magnet in the storage box or charge station that switches the reed contact in the hearing aid by means of its direct magnetic field so that the hearing aid is deactivated without an operator control component being actuated. A disadvantage with reed contacts is their volume and their movable contact elements, which not only require a high degree of expenditure to manufacture but also have a relatively short service life.

SUMMARY OF THE INVENTION

An object of the present invention is to provide a hearing aid, which can be switched automatically with reduced manufacturing expenditure and increased compactness as well as prolonged service life.

This object is achieved according to the invention by a hearing aid having a first hearing aid function, a second hearing aid function and a switching device for automatically switching from the first hearing aid function into the second hearing aid function, the switching device having at least one magnetic field-controlled ferrite component that exhibits a change in impedance that is used as a basis for the automatic switching.

The invention is based on the recognition that the change in the permeability of a ferrite component as a function of an applied magnetic field can be utilized for the automatic switching of a hearing aid. The continuous change in permeability as a function of the strength of the applied magnetic field brings about a change in the impedance or inductance in a suitable ferrite component and thus can be used to trigger switching.

The first hearing aid function preferably is a microphone operating mode, and the second hearing aid function a telephone coil operating mode. As a result, when making a telephone call, it is possible to switch automatically from the microphone operating mode into the telephone coil operating mode when a telephone receiver with a permanent magnet is placed against the ear. The first hearing aid function, however, may be the switched-on state, and the second hearing aid function may be the switched-off state of the hearing aid. In this case, the hearing aid can, as explained above, be switched on and off by insertion into the storage box, for example.

The magnetic-field-controlled ferrite component can be implemented as an SMD ferrite. As a result, the component that is usually used in the high frequency range is used in the present case as a magnetic field sensor.

The magnetic-field-controlled ferrite component alternately can be implemented as a coil with a ferrite core. In this case, the switching device preferably has an LC oscillator circuit, the inductance of which is formed by the coil, in order to detect a change in inductance of the coil with the ferrite core.

In a preferred embodiment, the switching device has a bridge circuit for detecting the change in impedance. In this case, the bridge circuit can either be dependent on frequency or independent of frequency. In the case of the frequency-dependent bridge circuit, it is possible, for example, to use two SMD ferrites as bridge elements in order to increase the sensitivity.

The switching device preferably is equipped with a peak detector with which the change in impedance or inductance can be detected by reference to the maximum values of an alternating voltage signal. As a result, the proximity of a permanent magnet to the magnet-field-controlled component in the hearing aid can easily be determined.

The invention thus provides the following advantages:

- in comparison to a miniature reed contact (6 mm×1.5 mm) the magnetic field sensor can be very small in design, specifically 2 mm×1 mm, for example,
- the ferrite operates without wear because it has no moving contacts,
- the sensor can be manufactured relatively cheaply,
- a ferrite sensor operates virtually without delay,
- the additional components which are necessary with a ferrite sensor system can easily be implemented in the signal processing IC of a hearing aid.

DESCRIPTION OF THE PREFERRED EMBODIMENTS

The exemplary embodiments which are described in more detail below represent preferred embodiments of the present invention.

Figure 1:
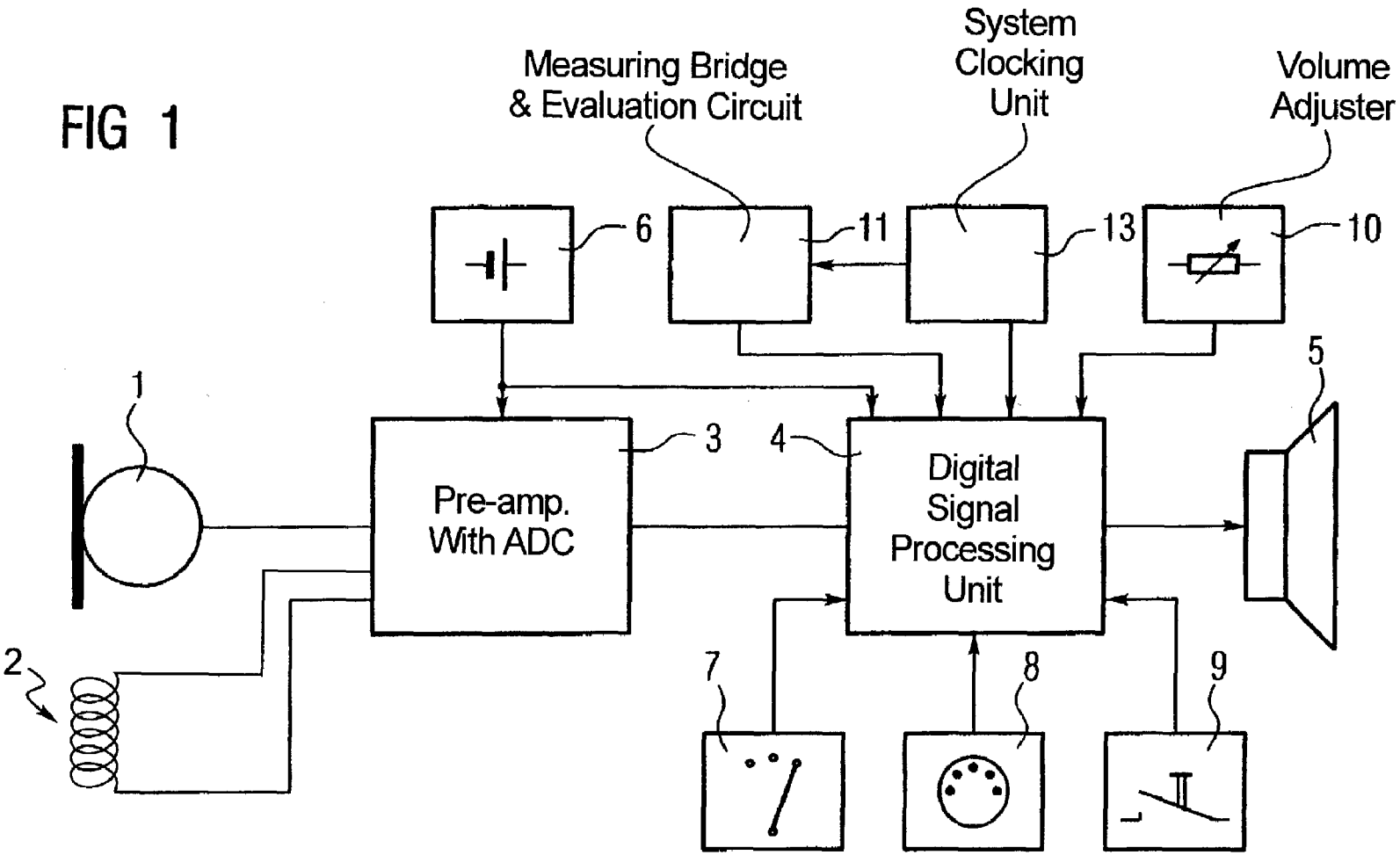
FIG. 1 is a block circuit diagram of a hearing aid according to the invention.

The hearing aid is represented as a block circuit diagram in FIG. 1 has two input components, specifically a microphone 1 and a telephone coil 2. The 30 signals of the two components are preamplified and digitized in a preamplifier 3 with A/D converter. The digital signal is conditioned in a signal processing device 4 for a receiver or speaker 5. A battery 6 provides the necessary supply voltage for the preamplifier 3 and the digital signal processing unit 4.

The digital signal processing unit 4 can be switched into the microphone operating mode, the telephone coil operating mode and the off state using a MTO switch. A programming socket 8 permits the digital signal processing unit 4 to be suitably programmed. The digital signal processing circuit 4 can also be switched, for example, from the telephone coil operating mode into a mixed mode with microphone depending on the situation and the surroundings, using a situation key 9. In the microphone operating mode, 10 the situation key 9 permits, for example, individual microphones or a number of microphones to be switched into the circuit and disconnected from the circuit. Finally, the volume of the hearing aid can be adjusted in the usual way using a volume adjuster 10.

A measuring bridge with evaluation circuit 11 to which an SMD ferrite sensor 12 (see FIG. 2) is connected is used to control the digital signal processing device 4. The measuring bridge and evaluation circuit 11 and the digital signal processing device 4 are supplied with a system clock or with an alternating voltage by a system clocking unit 13, which is formed essentially by an oscillator. As a result, a small SMD ferrite, which is usually applied in the high frequency range, can be used as a sensor for a static magnetic field. The hearing aid can be switched over or switched on and off as desired using the switching signal acquired from the SMD ferrite sensor 12 by the measuring bridge and evaluation circuit 11.

Figure 2:
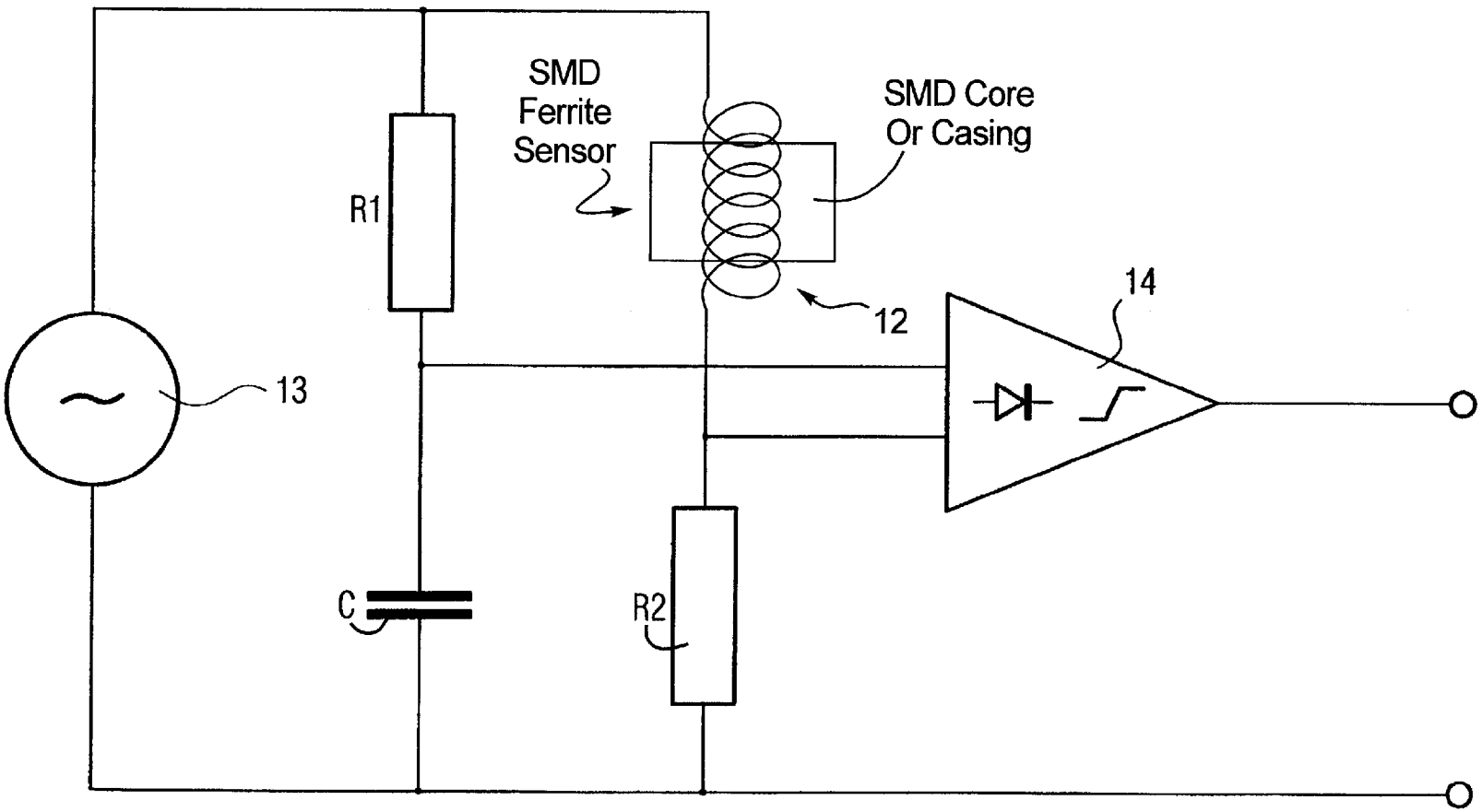
FIG. 2 is a Wheatstone bridge circuit with a demodulator and threshold value detector for the circuit in FIG. 1.

The design of the measuring bridge and evaluation circuit 11 is represented in more detail in FIG. 2. A Wheatstone bridge circuit has the SMD ferrite sensor 12 in a branch. The SMD ferrite sensor 12 has, inter alia, an inductive behavior which is characterized by the letter "L". The other branches of the Wheatstone bridge circuit have, as usual, two ohmic elements R1 and R2, as well as a capacitive element C.

The Wheatstone bridge circuit is fed by the system clocking unit or the oscillator 13, which applies a corresponding alternating voltage to the bridge. Since the circuit constitutes an alternating bridge circuit which is independent of the frequency, and the circuit thus operates independently of the oscillator frequency and the harmonic component, any desired clocking signals, even ones with unstable frequencies, can be used to supply the bridge.

If a static magnetic field is not present at the SMD ferrite sensor 12, the compensating condition R1*R2=L*C of the bridge circuit is fulfilled. In the difference branch, which forms the input for-a measuring amplifier 14, no voltage is generated in this case.

However, if the SMD ferrite sensor 12 is permeated by a static magnetic field, the inductance of the component changes as a result of the magnetization which is present. The alternating bridge circuit is consequently detuned and a correspondingly high voltage drop occurs in the difference branch.

The alternating voltage which is tapped off from the measuring amplifier 14 in the difference branch can be evaluated with a peak detector integrated into the measuring amplifier 14. After subsequent rectification and threshold value analysis in the measuring amplifier 14, a control signal for controlling the desired functions in the hearing aid or in the implant is obtained.

Instead of the simple SMD ferrite component which is formed by an electrical conductor surrounded by a ferrite casing, it is also possible to use a ferrite core which is wound with coil wire as the magnetic field sensor. This ferrite coil can also be evaluated by the alternating bridge circuit.

In an alternative embodiment of the present invention, an LC oscillator circuit is used to evaluate the ferrite component instead of the alternating bridge circuit. In this case, the ferrite component is used as a frequency-determining component, i.e. the change in inductance—accompanying the change in impedance—as a function of the static magnetic field is used. In this case, a direct magnetic field brings about the detuning of the oscillator circuit. The change in frequency is a measure of the strength of the magnetic field which is present.

In a further embodiment of the present invention, it is possible to use a frequency-dependent bridge circuit instead of a bridge circuit which is independent of the frequency. This would have the advantage that two SMB ferrites or ferrite coils which react to the magnetic field could be used in order to increase the sensitivity considerably. However, this requires a stable oscillator frequency.

In principle, a Hall sensor can also be used as the magnetic field sensor, said Hall sensor constituting then the magnetic-field-controlled impedance in the widest sense. However, the Hall sensor has the disadvantage of relatively high power consumption.

Although modifications and changes may be suggested by those skilled in the art, it is the intention of the inventor to embody within the patent warranted hereon all changes and modifications as reasonably and properly come within the scope of his contribution to the art.

The invention claimed is:

1. A hearing aid comprising:

hearing aid circuitry operable according to a first hearing aid function and according to a second hearing aid function;

a switching signal generator connected to said hearing aid circuitry that generates a switching signal that causes said hearing aid circuitry to switch between respective operation according to first and second hearing aid functions;

a signal source; and a Wheatstone bridge circuit connected between said signal source and said switching signal generator, said Wheatstone bridge comprising a first branch containing a single magnetic field-controlled ferrite component that exhibits a magnetic field-dependent impedance change dependent on a magnetic field, a second branch containing a first ohmic resistor, a third branch containing a second ohmic resistor, and a fourth branch containing a capacitive element, said impedance change of said ferrite component, when said magnetic field is present, changing an output status of said Wheatstone bridge that causes said switching signal generator to switch said hearing aid circuitry.

2. A hearing aid as claimed in claim 1, comprising a microphone connected to said hearing aid circuitry and a telephone coil connected to said hearing aid circuitry, and wherein said hearing aid circuitry is operable in a microphone operating mode, as said first hearing aid function, and in a telephone coil operating mode, as said second hearing aid function.

3. A hearing, aid as claimed in claim 1 wherein said magnetic field-controlled ferrite component is an SMD ferrite.

4. A hearing aid as claimed in claim 1 wherein said magnetic field-controlled ferrite component comprises a coil with a ferrite core.

5. A hearing aid as claimed in claim 4 wherein said switching device comprises an LC oscillator circuit have an inductance formed by said coil, and a detection for detecting a change in inductance of said coil with said ferrite core.

6. A hearing aid as claimed in claim 1, wherein said switching device comprises a peak detector for detecting a change in said impedance of said ferrite component with respect to a maximum value of an alternating voltage signal.

7. A hearing aid as claimed in claim 1 wherein said signal source is a source for an oscillating signal.

* * * * *